US010556717B2

(12) United States Patent
Lun et al.

(10) Patent No.: US 10,556,717 B2
(45) Date of Patent: Feb. 11, 2020

(54) PACKAGING ASSEMBLY COMPRISING A TIGHTENING PORTION, A BOX PORTION, A FLEXIBLE STRIP AND A PAIR OF SECURING MEMBERS

(71) Applicant: E-pac Packaging Services Co. Ltd., Shatin, N.T., Hong Kong (CN)

(72) Inventors: Tin Yeu Terence Lun, Hong Kong (CN); Zhong Zhu Luo, DongGuan (CN); Shi Hu Zhou, DongGuan (CN)

(73) Assignee: E-PAC PACKAGING SERVICES CO. LTD., Shatin, N.T. (HK)

( * ) Notice: Subject to any disclaimer, the term of this patent is extended or adjusted under 35 U.S.C. 154(b) by 396 days.

(21) Appl. No.: 15/456,479

(22) Filed: Mar. 10, 2017

(65) Prior Publication Data

US 2018/0257810 A1 Sep. 13, 2018

(51) Int. Cl.

| | |
|---|---|
| ***B65D 81/07*** | (2006.01) |
| ***B65D 5/50*** | (2006.01) |
| ***B65D 5/22*** | (2006.01) |

(52) U.S. Cl.

CPC ..... *B65D 5/5088* (2013.01); *B65D 5/22* (2013.01)

(58) Field of Classification Search

CPC ..... B65D 81/075; B65D 81/07; B65D 5/22; B65D 5/5088

USPC ..... 206/583

See application file for complete search history.

(56) References Cited

U.S. PATENT DOCUMENTS

| | | | | |
|---|---|---|---|---|
| 4,852,743 | A | 8/1989 | Ridgeway | |
| 4,923,065 | A | 5/1990 | Ridgeway | |
| 5,071,009 | A | 12/1991 | Ridgeway | |
| 5,388,701 | A | 2/1995 | Ridgeway | |
| 5,579,917 | A * | 12/1996 | Lofgren | B65D 81/075 206/583 |
| 5,678,695 | A | 10/1997 | Ridgeway et al. | |
| 5,891,462 | A | 4/1999 | Carrara | |
| 6,010,006 | A | 1/2000 | Ridgeway et al. | |
| 6,148,590 | A | 11/2000 | Ridgeway et al. | |
| 6,148,591 | A | 11/2000 | Ridgeway et al. | |
| 6,289,655 | B1 | 9/2001 | Ridgeway et al. | |
| 6,311,844 | B1 | 11/2001 | Ridgeway et al. | |
| 6,467,624 | B1 * | 10/2002 | Lofgren | B65D 81/07 206/583 |
| 7,097,043 | B2 | 8/2006 | Hsu | |
| 7,481,355 | B2 | 1/2009 | Hui | |
| 8,573,471 | B2 | 11/2013 | Wong | |
| 9,309,024 | B2 | 4/2016 | Hammerschmidt et al. | |
| 9,428,300 | B2 | 8/2016 | Sharp | |
| 9,487,323 | B2 | 11/2016 | Yamamura | |
| 9,580,202 | B2 | 2/2017 | Pettersson | |
| 2014/0076769 | A1 * | 3/2014 | McDonald | B65B 55/20 206/583 |

(Continued)

FOREIGN PATENT DOCUMENTS

CN 201999267 U 10/2011

*Primary Examiner* — King M Chu

(74) *Attorney, Agent, or Firm* — Squire Patton Boggs (US) LLP

(57) ABSTRACT

Provided herein is, among other things, a packaging assembly comprising at least a substantially rigid panel, a tightening portion, a box portion, a flexible strip and securing members, wherein an object to be packaged is held securely between the flexible strip and the rigid panel. Also provided herein are methods of packaging an object using the packaging assembly disclosed herein.

14 Claims, 9 Drawing Sheets

(56) References Cited

U.S. PATENT DOCUMENTS

2015/0314936 A1 11/2015 Stack, Jr.

* cited by examiner

PACKAGING ASSEMBLY COMPRISING A TIGHTENING PORTION, A BOX PORTION, A FLEXIBLE STRIP AND A PAIR OF SECURING MEMBERS

FIELD OF THE INVENTION

Provided herein are packaging assemblies comprising at least a substantially rigid panel, a tightening portion, a box portion, a flexible strip and securing members, wherein an object to be packaged is held securely between the flexible strip and the rigid panel. Also provided herein are methods of packaging an object using the packaging assembly disclosed herein.

BACKGROUND OF THE INVENTION

Packaging assemblies have long been used to secure an object to be packaged which requires protection from physical shock, dust, dirt and other contaminants. For example, when shipping objects which is comparatively fragile or sensitive, it is often desirable to secure the object inside a box to protect the object from physical shocks, dust, dirt and other contaminants which may occur during loading, transit and unloading.

Many packaging assemblies include a rigid panel, a flexible film material and additional structures to keep an object and the packaging assembly within a box from moving uncontrollably in the box. Such additional structures generally include a pair of folding side flaps and a pair of folding end flaps around a center portion of the rigid panel. An object is inserted between the flexible film material and the center portion and is secured when the folding side flaps are folded away from the flexible film material to tighten the flexible film material against the object. The folding end flaps are then folded in the same or opposite direction to the folding side flaps. The rigid panel in its folded condition is then placed in a box having interior dimensions which correspond to the peripheral dimensions of the folded rigid panel. The major problem with this type of packaging assembly is that it is difficult to keep the packaging assembly in the folded condition by one assembler. It is because while the pair of folding side flaps are folded in order to tighten the flexible film material against the object, the tension created on the flexible film material means that the pair of folding side flaps would rebound to an unfolded condition. Thus, the flexible film material would remain relaxed over the object unless an assembler continuously holds onto the pair of folding side flaps with both hands. With both hands being occupied, the assembler could not fold the pair of folding end flaps without the assistance of an additional assembler. Without fixing both pairs of folding side flaps and folding end flaps to their respective folded positions, the rigid panel could not be smoothly fitted into a box having interior dimensions which correspond to the peripheral dimensions of the folded rigid panel.

An objective of the present invention is to provide a packaging assembly formed by folding a rigid panel into a box and securing objects onto the box by a flexible strip to prevent uncontrolled movement of the objects when the objects are packaged within the box, and suitable for packaging an electronic product, such as a mobile phone or a tablet. A further objective of the present invention is to provide a packaging assembly formed by folding a rigid panel into a tightening portion and connecting the tightening portion to a box, and thus simplifying consumables and reducing cost. Still another objective of the present invention is to provide a packaging assembly that can be easily operated by a single assembler.

SUMMARY OF THE INVENTION

Provided herein are packaging assemblies formed by folding a rigid panel into a box and securing objects onto the box by a flexible strip to prevent uncontrolled movement of the objects when the objects are packaged within the box, and suitable for packaging an electronic product, such as a mobile phone or a tablet. Also provided herein is a packaging assembly formed by folding a rigid panel into a tightening portion and connecting the tightening portion to a box, and thus simplifying consumables and reducing cost. Also provided herein is a packaging assembly that can be easily operated by a single assembler.

In one aspect, provided herein is a packaging assembly comprising:

a) a tightening portion, wherein the tightening portion comprises a first rigid panel, wherein the first rigid panel comprises:

(i) a pair of first side edges and a pair of first end edges;

(ii) a center portion near the center of the first rigid panel;

(iii) a pair of first openings near the center of the center portion;

(iv) a first folding side portion connected to either the right side or the left side of the center portion;

(v) a first fold line; and (vi) one or more supporting members connected to the other sides of the center portion;

wherein the pair of first side edges are substantially transverse to the pair of first end edges, wherein the first fold line, one of the pair of first side edges and the pair of first end edges define the center portion, wherein the first fold line is substantially parallel to the pair of the first side edges, and wherein the first fold line, one of the pair of first side edges and the pair of first end edges define the first folding side portion;

b) a flexible strip having a pair of sleeves at the both ends;

c) a pair of dumbbell or dog-bone shaped securing members, each having a pair of end portions and a center region, wherein the center region is narrower than the end portions; and d) a box portion with an open upper end, wherein the first side edge on the first folding side portion is integrally and foldably connected or bonded to an edge of the box portion, and wherein each of the pair of securing members engages with each of the pair of sleeves respectively in a manner such that at least a portion of the center region is inside the sleeve; and wherein each of the pair of securing members respectively is configured to pass through each of the pair of first openings and to tighten an object between the strip and the first rigid panel.

In another aspect, provided herein is a method for packaging an object in the packaging assembly disclosed herein, wherein the method comprises the steps of inserting one of the securing members through one of the pair of first openings on the first rigid panel, extending and through the other first opening on the first rigid panel, whereby at least a portion of an object positioned between the pair of first openings on the first rigid panel and the flexible strip is tightened against a least a portion of the object when the pair of securing members are rotated along the flexible strip until the pair of securing members are fastened against a surface of the first rigid panel.

In some embodiments, the flexible strip further comprises a line of perforated holes across the width of the strip.

In certain embodiments, the flexible strip is an elastomer or a thermoplastic.

In some embodiments, each of the securing members independently comprises a thermoplastic, a metal, wood, a fiberboard or a combination thereof.

In certain embodiments, each of the securing members is a thermoplastic.

In some embodiments, the box portion is a substantially rectangular or square box with an open upper end.

In certain embodiments, the box portion is formed by a second rigid panel which can be folded into a box.

In some embodiments, the second rigid panel comprises:

a) a first segment, a second segment, a third segment and a fourth segment, wherein the first segment, the second segment, the third segment and fourth segment are of equal width, wherein the second segment is between the first segment and the third segment, wherein the third segment is between the second segment and the fourth segment, and wherein the fourth segment is connected to the first rigid panel through the first side edge;

b) a second fold line in between the first segment and the second segment and a pair of third fold lines each in between the second segment and the third segment and in between the third segment and the fourth segment respectively, wherein the second fold line and the pair of third fold lines are substantially parallel to each other;

c) a pair of proximal segments, each connected respectively to a side of the third segment not connecting to the second segment nor the fourth segment;

d) a pair of fourth fold lines each in between the third segment and the pair of proximal segments, wherein the pair of fourth fold lines are substantially transverse to the second fold line and the pair of third fold lines;

e) a pair of second openings, each near the center of the first folding side portion and the first segment respectively; and f) a pair of third openings, each near the center of the second segment and the fourth segment respectively;

wherein each of the pair of securing members respectively is configured to pass through either the pair of second openings and the pair of third openings, or each of the pair of first openings, and to tighten an object between the strip and the first rigid panel.

In certain embodiments, the second rigid panel further comprises:

a) a pair of distal segments, each connected respectively to one of the proximal segments; and b) a pair of fifth fold lines each in between the pair of proximal segments and the distal segments, wherein the pair of fifth fold lines are substantially parallel to the pair of fourth fold lines, and wherein the pair of fifth fold lines are substantially transverse to the second fold line and the pair of third fold lines.

In some embodiments, the second rigid panel further comprises:

a) a tuck tab each foldably connected to the shorter sides of the second segment and fourth segment;

b) a tuck tab each foldably connected to the shorter sides of the pair of distal segments;

c) a locking tab each on the edge of the pair of distal segments and the first segment;

d) a pair of fourth openings each along or near each of the pair of fourth fold lines; and e) a fifth opening along or near the third fold line in between the second segment and the third segment, wherein the pair of fourth openings are substantially aligned to the locking tabs on the edges of the pair of distal segments, and wherein the fifth opening is substantially aligned to the locking tab on the edge of the first segment.

In certain embodiments, the first rigid panel and the second rigid panel having an unfolded condition in which the tightening portion and the box portion are substantially coplanar with each other, and having a folded condition in which:

(i) the second segment and the fourth segment each are folded towards the third segment until the second segment and the fourth segment are each substantially transverse to the third segment, (ii) the tuck tabs on the second segment and the fourth segment are folded towards the third segment until the tuck tabs are substantially aligned to the pair of fourth fold lines and substantially transverse to the third segment, (iii) the pair of proximal segments are folded towards the third segment until the pair of proximal segments are substantially transverse to the third segment, (iv) the pair of distal segments are folded towards the third segment until the pair of distal segments are substantially transverse to the third segment and the locking tabs on each of the edges of the pair of distal segments are each inserted through the closest fourth opening, (v) the first segment is folded towards the third segment until the first segment is substantially transverse to the third segment and the locking tab on the edge of the first segment is inserted through the fifth opening, and (vi) the first folding side portion and the supporting members are folded towards the third segment until the first folding side portion and the supporting members are substantially transverse to the third segment and the center portion of the first rigid panel is above the third segment.

In another aspect, provided herein is a method for packaging an object in the packaging assembly disclosed herein, wherein the first rigid panel and the second rigid panel are in the folded condition, and wherein the method comprises the steps of inserting one of the securing members through one of the pair of third openings, extending across the center portion and through the other third opening, whereby at least a portion of an object positioned between the center portion and the flexible strip is tightened against a least a portion of the object when the pair of securing members are rotated along the flexible strip until the pair of securing members are each fastened against a surface of the second segment and the fourth segment respectively.

In some embodiments, the second rigid panel further comprises a sixth opening in or near the center of the third segment.

DETAILED DESCRIPTION OF THE INVENTION

Definitions

Figure 1:
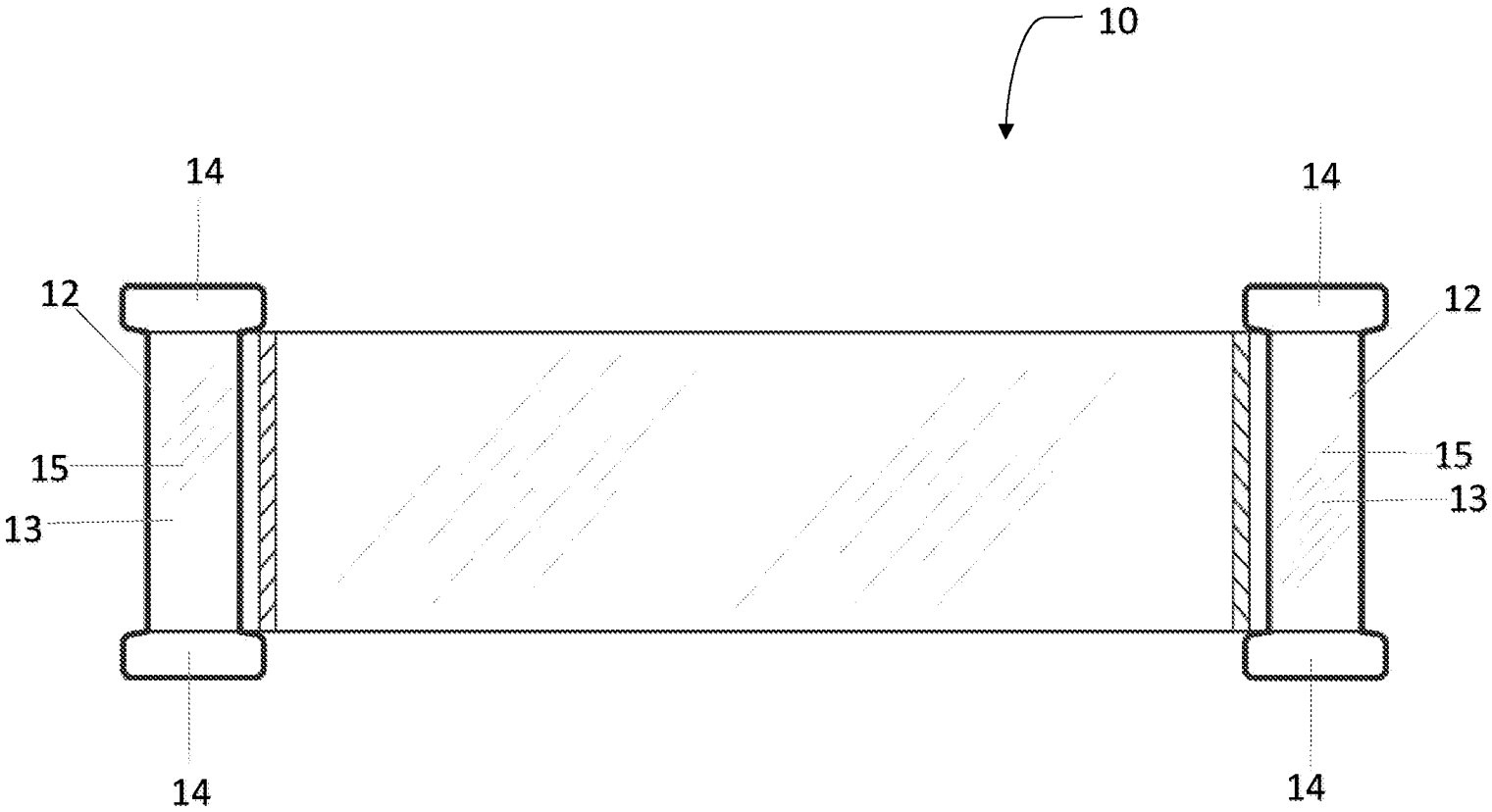
FIG. 1 depicts a plan view of an embodiment of the flexible strip disclosed herein.

The terms "first rigid panel" and "second rigid panel" each refers to a panel which is formed of any substantially rigid material and is substantially rectangular in shape. In certain embodiments, the substantially rigid material can hold a load of at least about 0.5 kg, at least about 1 kg, at least about 2 kg, at least about 3 kg, at least about 4 kg, at least about 6 kg, at least about 8 kg or at least about 10 kg per 400 $cm^2$ of the substantially rigid material.

The term "flexible strip" refers to a generally flexible material that is used to secure an object against the rigid panel and prevent uncontrolled movement of the object to be packaged.

The term "sleeve" refers to a tubular portion that is formed by a loop each at both ends of the flexible strip. In some embodiments, the loop is fastened by sewing, adhering, gluing, heat welding, ultrasonic welding, stapling, tacking, fastening, clipping, anchoring, retaining, securing or a combination thereof.

The term "securing member" refers to a generally rigid material that is in the shape of a tensile test specimen. In some embodiments the securing member is made of thermoplastic. In certain embodiments, the securing member is made of metal. In some embodiments, the securing member is made of wood. In certain embodiments, the securing member is made of fiberboard. Of course, it will be understood that a number of materials or a combination of materials are suitable for the securing member and can be selected, or custom designed, by those familiar with such materials without undue experimentation.

The term "object" includes any consumer goods that are generally categorized as merchandise and/or other item of common daily use, and/or industrial goods that are generally categorized as equipment, machinery, materials and/or other goods or component parts for use and/or consumption by other industries and/or firms.

The term "tightening portion" refers to a portion of the packaging assembly that is formed by the first rigid panel.

The term "box portion" refers to a portion of the packaging assembly this is a box with an open upper end. In some embodiments, the box can be formed by folding the second rigid panel disclosed herein. In certain embodiments, the box can be formed by any conventional methods known to a person of ordinary skill in the art. Examples of forming the box are described in more detail in U.S. Pat. Nos. 7,097,043; 7,481,355; 8,573,471; 9,428,300; 9,487,323; and 9,580,202, each of which is incorporated herein in its entirety by reference.

The term "substantially rectangular shape" includes rectangular shapes with rounded or sloped corners. In some embodiments, the term "substantially rectangular shape" includes openings anywhere and cutouts along the edges of the rectangular shape. In further embodiments, the term "substantially rectangular shape" includes any irregular shapes that has a substantial portion of its outer edges touching the boundaries of a rectangle.

The term "edge" of the rigid panel disclosed herein refers to a line or border at which a surface on the rigid panel terminates. The line or border can be curved, straight or substantially straight.

The term "side edge" of the rigid panel disclosed herein refer to any edge of the rigid panel that is vertical as seen by an observer when the rigid panel lies flat on a surface. In some embodiments, the side edge is substantially parallel to the first fold line.

The term "end edge" of the rigid panel disclosed herein refer to any edge of the rigid panel that is horizontal as seen by an observer when the rigid panel lies flat on a surface. In some embodiments, the end edge is substantially transverse to the first fold line.

The term "width" refers to the shortest distance between a pair of end edges of any portions or segments of the rigid panel. The distance is measured by the length of a line parallel to the first fold line and extending from one end edge to the other end edge of any given portion or segment of the rigid panel.

The term "fold line" refers to a line along which the panel may be creased, crimped, embossed, perforated, scored, or otherwise weakened so as to enhance the foldability of the panel.

The term "substantially parallel" refers to any two or more lines or portions having a general orientation accepting moderate ranges of deviation from absolute parallel that are commonly acceptable within the meaning of parallel within the container-folding field. In some embodiments, when the lines or portions intersect, the interior angle of intersection is about 0.5°, about 1°, about 1.5°, about 2°, about 2.5°, about 3°, about 5°, about 6°, about 8°, about 9° or about 10°. In certain embodiments, the corresponding angle of intersection is from about 0.5° to about 10°.

The term "substantially transverse" refers to any set of lines or portions having a slight departure from an absolute perpendicular arrangement. In some embodiments, when the two lines or portions intersect, the interior angle of intersection is 85°, 86°, 87°, 88°, 89°, 90°, 91°, 92°, 93°, 94° or 95°. In certain embodiments, the interior angle of intersection is from about 85° to about 95°.

The term "substantially coplanar" refers to any set of segments or portions having a slight departure from lying absolutely on the same plane. In some embodiments, a set of segments or portions are substantially coplanar when the interior angle between the set of segments or portions is 170°, 171°, 172°, 173°, 174°, 175°, 176°, 177°, 178°, 179°, 180°, 181°, 182°, 183°, 184°, 185°, 186°, 187°, 188°, 189° or 190°. In certain embodiments, a set of segments or portions are substantially coplanar when the interior angle between the set of segments or portions is from about 170° to about 190°

The term "substantially 0 degree" refers to 0°, 1°, 2°, 3°, 4° or 5°.

The term "transparent" refers to polymeric material with a transparency value of about 65%, about 70%, about 75%, about 80%, about 85%, about 90%, about 95%, about 99% or about 99.9% as measured in accordance with ASTM D1746.

The term "translucent" refers to polymeric material with a transparency value of about 35%, about 40%, about 45%, about 50%, about 55% or about 60% as measured in accordance with ASTM D1746.

The term "opaque" refers to polymeric material with a transparency value of about 5%, about 10%, about 15%, about 20%, about 25% or about 30% as measured in accordance with ASTM D1746.

The term "sewing" refers to a single loop of thread that is passed through a piece of material. In some embodiments, the thread is made of cotton. In certain embodiments, the thread is made of natural fiber. In some embodiments, the thread is made of animal fiber. In certain embodiments, the thread is made of synthetic fiber. In some embodiments, the thread is made of polyester. In certain embodiments, the thread is made of fusible. In some embodiments, the thread is made of linen. In certain embodiments, the thread is made of metal. In some embodiments, the thread is made of nylon. In certain embodiments, the thread is made of rayon. In some embodiments, the thread is made of silk. In certain embodiments, the thread is made of wool. In some embodiments, the thread cannot be made of water-soluble. Of course, it will be understood that a number of materials are suitable for the thread and can be selected, or custom designed, by those familiar with such materials without undue experimentation.

The term "unfolded condition" refers to the condition which the tightening portion and the box portion are substantially coplanar. Of course, it will be understood that the unfolded condition of the rigid panel is in a state which the rigid panel is ready to accept an object to be secured.

The term "folded condition" refers to the condition which the rigid panel is in a state which the rigid panel is ready to engage the flexible strip and the pair of securing members to secure an object to be packaged.

The term "copolymer" refers to a polymer derived from two or more types of monomers, including terpolymers.

Provided herein are packaging assemblies formed by folding a rigid panel into a box and securing objects onto the box by a flexible strip to prevent uncontrolled movement of the objects when the objects are packaged within the box, and suitable for packaging an electronic product, such as a mobile phone or a tablet. Also provided herein is a packaging assembly formed by folding a rigid panel into a tightening portion and connecting the tightening portion to a box, and thus simplifying consumables and reducing cost. Also provided herein is a packaging assembly that can be easily operated by a single assembler. It will be understood that many of the features of the embodiments discussed below may be used in combination with the features of the other various embodiments.

In one aspect, provided herein is a packaging assembly comprising:

a) a tightening portion, wherein the tightening portion comprises a first rigid panel, wherein the first rigid panel comprises:

(i) a pair of first side edges and a pair of first end edges;

(ii) a center portion near the center of the first rigid panel;

(iii) a pair of first openings near the center of the center portion;

(iv) a first folding side portion connected to either the right side or the left side of the center portion;

(v) a first fold line; and (vi) one or more supporting members connected to the other sides of the center portion;

wherein the pair of first side edges are substantially transverse to the pair of first end edges, wherein the first fold line, one of the pair of first side edges and the pair of first end edges define the center portion, wherein the first fold line is substantially parallel to the pair of first side edges, and wherein the first fold line, one of the pair of first side edges and the pair of first end edges define the first folding side portion;

b) a flexible strip having a pair of sleeves at the both ends;

c) a pair of dumbbell or dog-bone shaped securing members, each having a pair of end portions and a center region, wherein the center region is narrower than the end portions; and d) a box portion with an open upper end, wherein the first side edge on the first folding side portion is integrally and foldably connected or bonded to an edge of the box portion, and wherein each of the pair of securing members engages with each of the pair of sleeves respectively in a manner such that at least a portion of the center region is inside the sleeve; and wherein each of the pair of securing members respectively is configured to pass through each of the pair of first openings and to tighten an object between the strip and the first rigid panel.

In another aspect, provided herein is a method for packaging an object in the packaging assembly disclosed herein, wherein the method comprises the steps of inserting one of the securing members through one of the pair of first openings on the first rigid panel, extending and through the other first opening on the first rigid panel, whereby at least a portion of an object positioned between the pair of first openings on the first rigid panel and the flexible strip is tightened against a least a portion of the object when the pair of securing members are rotated along the flexible strip until the pair of securing members are fastened against a surface of the first rigid panel.

In some embodiments, the flexible strip further comprises a line of perforated holes across the width of the strip.

In certain embodiments, the flexible strip is an elastomer or a thermoplastic.

In some embodiments, each of the securing members independently comprises a thermoplastic, a metal, wood, a fiberboard or a combination thereof.

In certain embodiments, each of the securing members is a thermoplastic.

In some embodiments, the box portion is a substantially rectangular or square box with an open upper end.

In certain embodiments, the box portion is formed by a second rigid panel which can be folded into a box.

In some embodiments, the second rigid panel comprises:

g) a first segment, a second segment, a third segment and a fourth segment, wherein the first segment, the second segment, the third segment and fourth segment are of equal width, wherein the second segment is between the first segment and the third segment, wherein the third segment is between the second segment and the fourth segment, and wherein the fourth segment is connected to the first rigid panel through the first side edge;

h) a second fold line in between the first segment and the second segment and a pair of third fold lines each in between the second segment and the third segment and in between the third segment and the fourth segment respectively, wherein the second fold line and the pair of third fold lines are substantially parallel to each other;

i) a pair of proximal segments, each connected respectively to a side of the third segment not connecting to the second segment nor the fourth segment;

j) a pair of fourth fold lines each in between the third segment and the pair of proximal segments, wherein the pair of fourth fold lines are substantially transverse to the second fold line and the pair of third fold lines;

k) a pair of second openings, each near the center of the first folding side portion and the first segment respectively; and l) a pair of third openings, each near the center of the second segment and the fourth segment respectively;

wherein each of the pair of securing members respectively is configured to pass through either the pair of second openings and the pair of third openings, or each of the pair of first openings, and to tighten an object between the strip and the first rigid panel.

In certain embodiments, the second rigid panel further comprises:

c) a pair of distal segments, each connected respectively to one of the proximal segments; and d) a pair of fifth fold lines each in between the pair of proximal segments and the distal segments, wherein the pair of fifth fold lines are substantially parallel to the pair of fourth fold lines, and wherein the pair of fifth fold lines are substantially transverse to the second fold line and the pair of third fold lines.

In some embodiments, the second rigid panel further comprises:

f) a tuck tab each foldably connected to the shorter sides of the second segment and fourth segment;

g) a tuck tab each foldably connected to the shorter sides of the pair of distal segments;

h) a locking tab each on the edge of the pair of distal segments and the first segment;

i) a pair of fourth openings each along or near each of the pair of fourth fold lines; and j) a fifth opening along or near the third fold line in between the second segment and the third segment, wherein the pair of fourth openings are substantially aligned to the locking tabs on the edges of the pair of distal segments, and wherein the fifth opening is substantially aligned to the locking tab on the edge of the first segment.

In certain embodiments, the first rigid panel and the second rigid panel having an unfolded condition in which the tightening portion and the box portion are substantially coplanar with each other, and having a folded condition in which:

(i) the second segment and the fourth segment each are folded towards the third segment until the second segment and the fourth segment are each substantially transverse to the third segment, (ii) the tuck tabs on the second segment and the fourth segment are folded towards the third segment until the tuck tabs are substantially aligned to the pair of fourth fold lines and substantially transverse to the third segment, (iii) the pair of proximal segments are folded towards the third segment until the pair of proximal segments are substantially transverse to the third segment, (iv) the pair of distal segments are folded towards the third segment until the pair of distal segments are substantially transverse to the third segment and the locking tabs on each of the edges of the pair of distal segments are each inserted through the closest fourth opening, (v) the first segment is folded towards the third segment until the first segment is substantially transverse to the third segment and the locking tab on the edge of the first segment is inserted through the fifth opening, and (vi) the first folding side portion and the supporting members are folded towards the third segment until the first folding side portion and the supporting members are substantially transverse to the third segment and the center portion of the first rigid panel is above the third segment.

In another aspect, provided herein is a method for packaging an object in the packaging assembly disclosed herein, wherein the first rigid panel and the second rigid panel are in the folded condition, and wherein the method comprises the steps of inserting one of the securing members through one of the pair of third openings, extending across the center portion and through the other third opening, whereby at least a portion of an object positioned between the center portion and the flexible strip is tightened against a least a portion of the object when the pair of securing members are rotated along the flexible strip until the pair of securing members are each fastened against a surface of the second segment and the fourth segment respectively.

In some embodiments, the second rigid panel further comprises a sixth opening in or near the center of the third segment.

The rigid panel disclosed herein can be in any shape and size suitable to be used for securing objects. In some embodiments, the rigid panel is substantially rectangular in shape. The rigid panel disclosed herein is formed of any substantially rigid material.

In some embodiments, the substantially rigid material is a corrugated cardboard. In certain embodiments, the corrugated cardboard is an A-Flute, B-Flute, C-Flute, E-Flute or F-Flute corrugated cardboard. In some embodiments, the substantially rigid material is a paperboard or a laminate. In other embodiments, the substantially rigid material is a plastic. In certain embodiments, the substantially rigid material is not a corrugated cardboard, a paperboard, a laminate or a plastic. In certain embodiments, the rigid panel is substantially continuous. In some embodiments, the rigid panel comprises one or more openings or cutouts on its surface or along its edges.

In certain embodiments, the rigid panel has an average thickness of at most about 0.75 mm, at most about 1.50 mm, at most about 3.00 mm, at most about 4.50 mm, at most about 6.00 mm, at most about 7.50 mm, at most about 10.00 mm or at most about 12.50 mm. In some embodiments, the rigid panel has an average thickness of at least about 0.075 mm, at least about 0.15 mm, at least about 0.30 mm, at least about 0.45 mm, at least about 0.60 mm, at least about 0.75 mm, at least about 1.00 mm or at least about 1.25 mm.

The flexible strip disclosed herein includes generally a thin continuous polymeric material, which can be transparent, translucent, opaque or colored. In certain embodiments, the flexible strip comprises any material that is suitable for packaging known to a person of ordinary skill in the art. Non-limiting examples of suitable materials include one or more fabrics, such as wovens, knits, nonwovens, openwork meshes, spandex, including Lycra® brand spandex and elastic fabrics. In some embodiments, the flexible strip has a thickness of at most about 0.2 mm, at most about 0.15 mm, at most about 0.13 mm, at most about 0.10 mm, at most about 0.08 mm, at most about 0.05 mm, at most about 0.04 mm, or at most about 0.03 mm. In certain embodiments, the flexible strip has a thickness of at least about 0.03 mm, at least about 0.04 mm, at least about 0.05 mm, or at least about 0.08 mm.

The flexible strip disclosed herein is generally an elastic polymeric material. In some embodiments, the flexible strip has an elastic recovery in the transverse direction and/or longitudinal direction of at least about 60%, at least about 65%, at least about 70%, at least about 75%, at least about 80%, at least about 85%, at least about 90%, at least about 95% or at least about 100% measured according to ASTM D5459 at 100% strain, 30 seconds relaxation time, and 60 second recovery time. In certain embodiments, the flexible strip has a Young's modulus of at least about 13,700 KPa, at least about 17,200 KPa, at least about 20,600 KPa, at least about 24,100 KPa, or at least about 27,500 KPa and/or at most about 55,100 KPa, at most about 68,900 KPa, at most about 103,400 KPa, at most about 137,800 KPa, or at most about 275,700 KPa as measured in accordance with ASTM D882 at a temperature of 73° F. In certain embodiments, the flexible strip has an ultimate elongation value of at least about 100%, at least about 200%, at least about 300%, at least about 400%, or at least about 500%, as measured in accordance with ASTM D412. In certain embodiments, the flexible strip has a low speed puncture maximum load of about 17 newton, about 20 newton, about 22 newton, about 24 newton, about 26 newton, about 28 newton or about 31 newton, measured according to ASTM F1306 using a cross-head speed of 127 mm per minute.

The elastic polymeric material can be an elastomer or a thermoplastic. In certain embodiments, the elastic polymeric material disclosed herein can comprise at least one additive for the purposes of improving and/or controlling the processibility, appearance, physical, chemical, and/or mechanical properties of the elastic polymeric material. Non-limiting examples of suitable additives include colorants or pigments, UV stabilizers, plasticizers, antioxidants, fillers, lubricants, antifogging agents, flow aids, coupling agents, cross-linking agents, nucleating agents, surfactants, slip agents, anti-blocking agents, solvents, flame retardants, anti-static agents, and combinations thereof. The total amount of the additives can range from about greater than 0 to about 80 wt. %, from about 0.001 wt. % to about 70 wt. %, from about 0.01 wt. % to about 60 wt. %, from about 0.1 wt. % to about 50 wt. %, from about 1 wt. % to about 40 wt. %, or from about 10 wt. % to about 50 wt. % of the total weight of the elastic polymeric material. Some polymer additives have been described in Zweifel Hans et al., "*Plastics Additives Handbook*," Hanser Gardner Publications, Cincinnati, Ohio, 5th edition (2001), which is incorporated herein by reference in its entirety.

In some embodiments, the elastic polymeric material is an elastomer. In certain embodiments, the elastomer includes natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethanes (e.g., polyether polyurethanes, polyester polyurethane, polycarbonate polyurethanes, and thermoplastic polyurethane elastomers). In some embodiments, the polymeric material is thermoplastic polyolefin elastomers (TPOs), which are two-component elastomer systems comprising an elastomer (such as EPDM) finely dispersed in a thermoplastic polyolefin (such as polypropylene or polyethylene).

In certain embodiments, the elastic polymeric material is a thermoplastic polyurethane elastomer. In certain embodiments, the thermoplastic polyurethane elastomer is ELASTOLLAN®, commercially available from the BASF company, Florham Park, USA.

In some embodiments, the elastic polymeric material is a thermoplastic modified with one or more additives for improving and/or controlling elasticity and/or appearance of the thermoplastic for the flexible strip disclosed herein. In some embodiments, the thermoplastic includes polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, and polyvinyl chloride.

In some embodiments, the elastic polymeric material disclosed herein can comprise a plasticizer or tackifier. In general, a plasticizer is a chemical that can increase the flexibility and lower the glass transition temperature of polymers. Any plasticizer disclosed herein can used for the elastic polymeric material. Non-limiting examples of plasticizers include mineral oils, abietates, adipates, alkyl sulfonates, azelates, benzoates, chlorinated paraffins, citrates, epoxides, glycol ethers and their esters, glutarates, hydrocarbon oils, isobutyrates, oleates, pentaerythritol derivatives, phosphates, phthalates, esters, polybutenes, ricinoleates, sebacates, sulfonamides, tri- and pyromellitates, biphenyl derivatives, stearates, difuran diesters, fluorine-containing plasticizers, hydroxybenzoic acid esters, isocyanate adducts, multi-ring aromatic compounds, natural product derivatives, nitriles, siloxane-based lamination agents, tar-based products, thioeters and combinations thereof. Where used, the amount of the plasticizer in the elastic polymeric material can be from greater than 0 to about 15 wt. %, from about 0.5 wt. % to about 10 wt. %, or from about 1 wt. % to about 5 wt. % of the total weight of the elastic polymeric material. Some plasticizers have been described in George Wypych, "*Handbook of Plasticizers*," ChemTec Publishing, Toronto-Scarborough, Ontario (2004), which is incorporated herein by reference.

In certain embodiments, the elastic polymeric material disclosed herein can comprise a tackifier. In general, a tackifier is a chemical that can increase the tack and lower the glass transition temperature of polymers. Any tackifier disclosed herein can used for the elastic polymeric material. Non-limiting examples of tackifiers include rosins and their derivatives, terpenes and modified terpenes, aliphatic, cycloaliphatic and aromatic resins (e.g., C5 aliphatic resins, C9 aromatic resins, and C5/C9 aliphatic/aromatic resins), hydrogenated hydrocarbon resins, and their mixtures, and terpene-phenol resins. Where used, the amount of the tackifier in the elastic polymeric material can be from greater than 0 to about 15 wt. %, from about 0.5 wt. % to about 10 wt. %, or from about 1 wt. % to about 5 wt. % of the total weight of the elastic polymeric material.

In some embodiments, the elastic polymeric material disclosed herein optionally comprise a colorant or pigment that can change the look of the elastic polymeric material to human eyes. Any colorant or pigment known to a person of ordinary skill in the art may be added to the elastic polymeric material disclosed herein. Non-limiting examples of suitable colorants or pigments include inorganic pigments such as metal oxides such as iron oxide, zinc oxide, and titanium dioxide, mixed metal oxides, carbon black, organic pigments such as anthraquinones, anthanthrones, azo and monoazo compounds, arylamides, benzimidazolones, BONA lakes, diketopyrrolo-pyrroles, dioxazines, disazo compounds, diarylide compounds, flavanthrones, indanthrones, isoindolinones, isoindolines, metal complexes, monoazo salts, naphthols, b-naphthols, naphthol AS, naphthol lakes, perylenes, perinones, phthalocyanines, pyranthrones, quinacridones, and quinophthalones, and combinations thereof. Where used, the amount of the colorant or pigment in the elastic polymeric material can be from about greater than 0 to about 10 wt. %, from about 0.1 wt. % to about 5 wt. %, or from about 0.25 wt. % to about 2 wt. % of the total weight of the elastic polymeric material. Some colorants have been described in Zweifel Hans et al., "*Plastics Additives Handbook*," Hanser Gardner Publications, Cincinnati, Ohio, 5th edition, Chapter 15, pages 813-882 (2001), which is incorporated herein by reference.

In certain embodiments, the elastic polymeric material disclosed herein optionally comprise an UV stabilizer that may prevent or reduce the degradation of the elastic polymeric material by UV radiations. Any UV stabilizer known to a person of ordinary skill in the art may be added to the elastic polymeric material disclosed herein. Non-limiting examples of suitable UV stabilizers include benzophenones, benzotriazoles, aryl esters, oxanilides, acrylic esters, formamidines, carbon black, hindered amines, nickel quenchers, hindered amines, phenolic antioxidants, metallic salts, zinc compounds and combinations thereof. Where used, the amount of the UV stabilizer in the elastic polymeric material can be from about greater than 0 to about 5 wt. %, from about 0.01 to about 3 wt. %, from about 0.1 wt. % to about 2 wt. %, or from about 0.1 wt. % to about 1 wt. % of the total weight of the elastic polymeric material. Some UV stabilizers have been described in Zweifel Hans et al., "*Plastics Additives Handbook*," Hanser Gardner Publications, Cincinnati, Ohio, 5th edition, Chapter 2, pages 141-426 (2001), which is incorporated herein by reference.

In certain embodiments, the elastic polymeric material disclosed herein can comprise a lubricant. In general, the lubricant can be used, inter alia, to modify the rheology of the molten elastic polymeric material, to improve the surface finish of molded articles, and/or to facilitate the dispersion of fillers or pigments. Any lubricant known to a person of ordinary skill in the art may be added to the elastic polymeric material disclosed herein. Non-limiting examples of suitable lubricants include fatty alcohols and their dicarboxylic acid esters, fatty acid esters of short-chain alcohols, fatty acids, fatty acid amides, metal soaps, oligomeric fatty acid esters, fatty acid esters of long-chain alcohols, montan waxes, polyethylene waxes, polypropylene waxes, natural and synthetic paraffin waxes, fluoropolymers and combinations thereof. Where used, the amount of the lubricant in the elastic polymeric material can be from about greater than 0 to about 5 wt. %, from about 0.1 wt. % to about 4 wt. %, or from about 0.1 wt. % to about 3 wt. % of the total weight of the elastic polymeric material. Some suitable lubricants have been disclosed in Zweifel Hans et al., "*Plastics Additives Handbook*," Hanser Gardner Publications, Cincinnati, Ohio, 5th edition, Chapter 5, pages 511-552 (2001), both of which are incorporated herein by reference.

Optionally, the elastic polymeric material disclosed herein can comprise an antistatic agent. Generally, the antistatic agent can increase the conductivity of the elastic polymeric material and to prevent static charge accumulation. Any antistatic agent known to a person of ordinary skill in the art may be added to the elastic polymeric material disclosed herein. Non-limiting examples of suitable antistatic agents include conductive fillers (e.g., carbon black, metal particles and other conductive particles), fatty acid esters (e.g., glycerol monostearate), ethoxylated alkylamines, diethanolamides, ethoxylated alcohols, alkylsulfonates, alkylphosphates, quaternary ammonium salts, alkylbetaines and combinations thereof. Where used, the amount of the antistatic agent in the elastic polymeric material can be from about greater than 0 to about 5 wt. %, from about 0.01 wt. % to about 3 wt. %, or from about 0.1 wt. % to about 2 wt. % of the total weight of the elastic polymeric material. Some suitable antistatic agents have been disclosed in Zweifel Hans et al., "*Plastics Additives Handbook*," Hanser Gardner Publications, Cincinnati, Ohio, 5th edition, Chapter 10, pages 627-646 (2001), both of which are incorporated herein by reference.

In some embodiments, the elastic polymeric material disclosed herein comprise a slip agent. In other embodiments, the elastic polymeric material disclosed herein do not comprise a slip agent. Slip is the sliding of film surfaces over each other or over some other substrates. The slip performance of films can be measured by ASTM D 1894, *Static and Kinetic Coefficients of Friction of Plastic Film and Sheeting*, which is incorporated herein by reference. In general, the slip agent can convey slip properties by modifying the surface properties of films; and reducing the friction between layers of the films and between the films and other surfaces with which they come into contact.

Any slip agent known to a person of ordinary skill in the art may be added to the elastic polymeric material disclosed herein. Non-limiting examples of the slip agents include primary amides having about 12 to about 40 carbon atoms (e.g., erucamide, oleamide, stearamide and behenamide); secondary amides having about 18 to about 80 carbon atoms (e.g., stearyl erucamide, behenyl erucamide, methyl erucamide and ethyl erucamide); secondary-bis-amides having about 18 to about 80 carbon atoms (e.g., ethylene-bis-stearamide and ethylene-bis-oleamide); and combinations thereof.

In certain embodiments, the slip agent is a primary amide with a saturated aliphatic group having between 18 and about 40 carbon atoms (e.g., stearamide and behenamide). In other embodiments, the slip agent is a primary amide with an unsaturated aliphatic group containing at least one carbon-carbon double bond and between 18 and about 40 carbon atoms (e.g., erucamide and oleamide). In further embodiments, the slip agent is a primary amide having at least 20 carbon atoms. In further embodiments, the slip agent is erucamide, oleamide, stearamide, behenamide, ethylene-bis-stearamide, ethylene-bis-oleamide, stearyl erucamide, behenyl erucamide or a combination thereof. In a particular embodiment, the slip agent is erucamide. In further embodiments, the slip agent is commercially available having a trade name such as ATMER™ SA from Uniqema, Everberg, Belgium; ARMOSLIP® from Akzo Nobel Polymer Chemicals, Chicago, Ill.; KEMAMIDE® from Witco, Greenwich, Conn.; and CRODAMIDE® from Croda, Edison, N.J. Where used, the amount of the slip agent in the elastic polymeric material can be from about greater than 0 to about 3 wt. %, from about 0.0001 wt. % to about 2 wt. %, from about 0.001 wt. % to about 1 wt. %, from about 0.001 wt. % to about 0.5 wt. % or from about 0.05 wt. % to about 0.25 wt. % of the total weight of the elastic polymeric material. Some slip agents have been described in Zweifel Hans et al., "*Plastics Additives Handbook*," Hanser Gardner Publications, Cincinnati, Ohio, 5th edition, Chapter 8, pages 601-608 (2001), which is incorporated herein by reference.

In some embodiments, the elastic polymeric material disclosed herein can comprise an anti-blocking agent. In some embodiments, the elastic polymeric material disclosed herein do not comprise an anti-blocking agent. The anti-blocking agent can be used to prevent the undesirable adhesion between touching layers of articles made from the elastic polymeric material, particularly under moderate pressure and heat during storage, manufacture or use. Any anti-blocking agent known to a person of ordinary skill in the art may be added to the elastic polymeric material disclosed herein. Non-limiting examples of anti-blocking agents include minerals (e.g., clays, chalk, and calcium carbonate), synthetic silica gel (e.g., SYLOBLOC® from Grace Davison, Columbia, Md.), natural silica (e.g., SUPER FLOSS® from Celite Corporation, Santa Barbara, Calif.), talc (e.g., OPTIBLOC® from Luzenac, Centennial, Colo.), zeolites (e.g., SIPERNAT® from Degussa, Parsippany, N.J.), aluminosilicates (e.g., SILTON® from Mizusawa Industrial Chemicals, Tokyo, Japan), limestone (e.g., CARBOREX® from Omya, Atlanta, Ga.), spherical polymeric particles (e.g., EPOSTAR®, poly(methyl methacrylate) particles from Nippon Shokubai, Tokyo, Japan and TOSPEARL®, silicone particles from GE Silicones, Wilton, Conn.), waxes, amides (e.g. erucamide, oleamide, stearamide, behenamide, ethylene-bis-stearamide, ethylene-bis-oleamide, stearyl erucamide and other slip agents), molecular sieves, and combinations thereof. The mineral particles can lower blocking by creating a physical gap between articles, while the organic anti-blocking agents can migrate to the surface to limit surface adhesion. Where used, the amount of the anti-blocking agent in the elastic polymeric material can be from about greater than 0 to about 3 wt. %, from about 0.0001 wt. % to about 2 wt. %, from about 0.001 wt. % to about 1 wt. %, or from about 0.001 wt. % to about 0.5 wt. % of the total weight of the elastic polymeric material. Some anti-blocking agents have been described in Zweifel Hans et al., "*Plastics Additives Handbook*," Hanser Gardner Publications, Cincinnati, Ohio, 5th edition, Chapter 7, pages 585-600 (2001), which is incorporated herein by reference.

The packaging assembly disclosed herein includes means of forming a pair of sleeves at both ends of the flexible strip so that each of the pair of securing members engages with each of the pair of sleeves in a manner such that at least a portion of the center region of the securing member is inside the sleeve. In some embodiments, the means includes sewing, adhering, gluing, heat welding, ultrasonic welding, stapling, tacking, fastening, clipping, anchoring, retaining, securing or a combination thereof.

In certain embodiments, the pair of securing members cooperate with each other to tighten the flexible strip against an object between the flexible strip and the first rigid panel when one of the securing members are inserted through one of the pair of first openings on the first rigid panel, whereby at least a portion of an object positioned between the pair of first openings on the first rigid panel and the flexible strip is tightened against a least a portion of the object when the pair of securing members are rotated along the flexible strip until the pair of securing members are fastened against a surface of the first rigid panel.

In some embodiments, the first rigid panel is integrally and foldably connected or bonded to an edge of a box with an open upper end and having inner dimensions corresponding to the peripheral dimensions of the first rigid panel. Thus, when first rigid panel is folded towards the box, the open upper end of the box is closed by the center portion and the secured object is maintained out of direct contact with the box in all three axes, which can further reduce the risk of physical impact damage.

In certain embodiments, wherein the box portion is formed by folding the second rigid panel, and wherein the first rigid panel and the second rigid panel are in the folded condition, the pair of securing members cooperate with each other to tighten the flexible strip against an object between the flexible strip and the first rigid panel when one of the pair of third openings, extending across the center portion and through the other third opening, whereby at least a portion of an object positioned between the center portion and the flexible strip is tightened against a least a portion of the object when the pair of securing members are rotated along the flexible strip until the pair of securing members are each fastened against a surface of the second segment and the fourth segment respectively.

FIG. 1 depicts a plan view of an embodiment of the flexible strip (10) disclosed herein comprising a pair of sleeves (12), wherein a pair of securing members (13) each comprising a pair of end portions (14) and a center region (15), wherein the center region (15) is narrower than the end portions (14), and wherein each of the pair of securing members (13) engages with each of the pair of sleeves (12) respectively in a manner such that at least a portion of the center region (15) is inside the sleeve (12).

Figure 2:
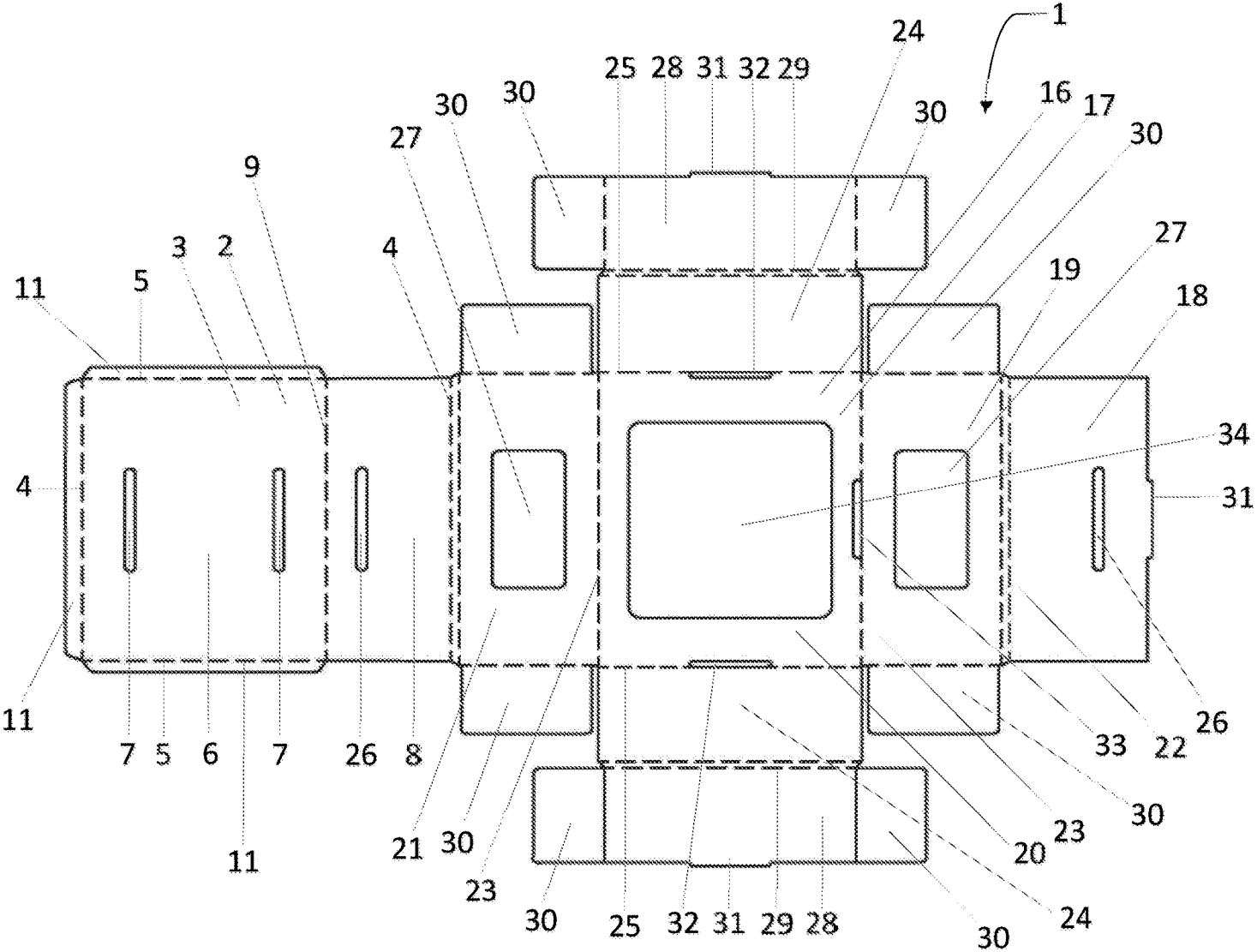
FIG. 2 depicts a plan view of an embodiment of the packaging assembly disclosed herein in an unfolded condition.

FIG. 2 depicts a plan view of an embodiment of the packaging assembly (1) disclosed herein in an unfolded condition comprising a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20)

and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 3:
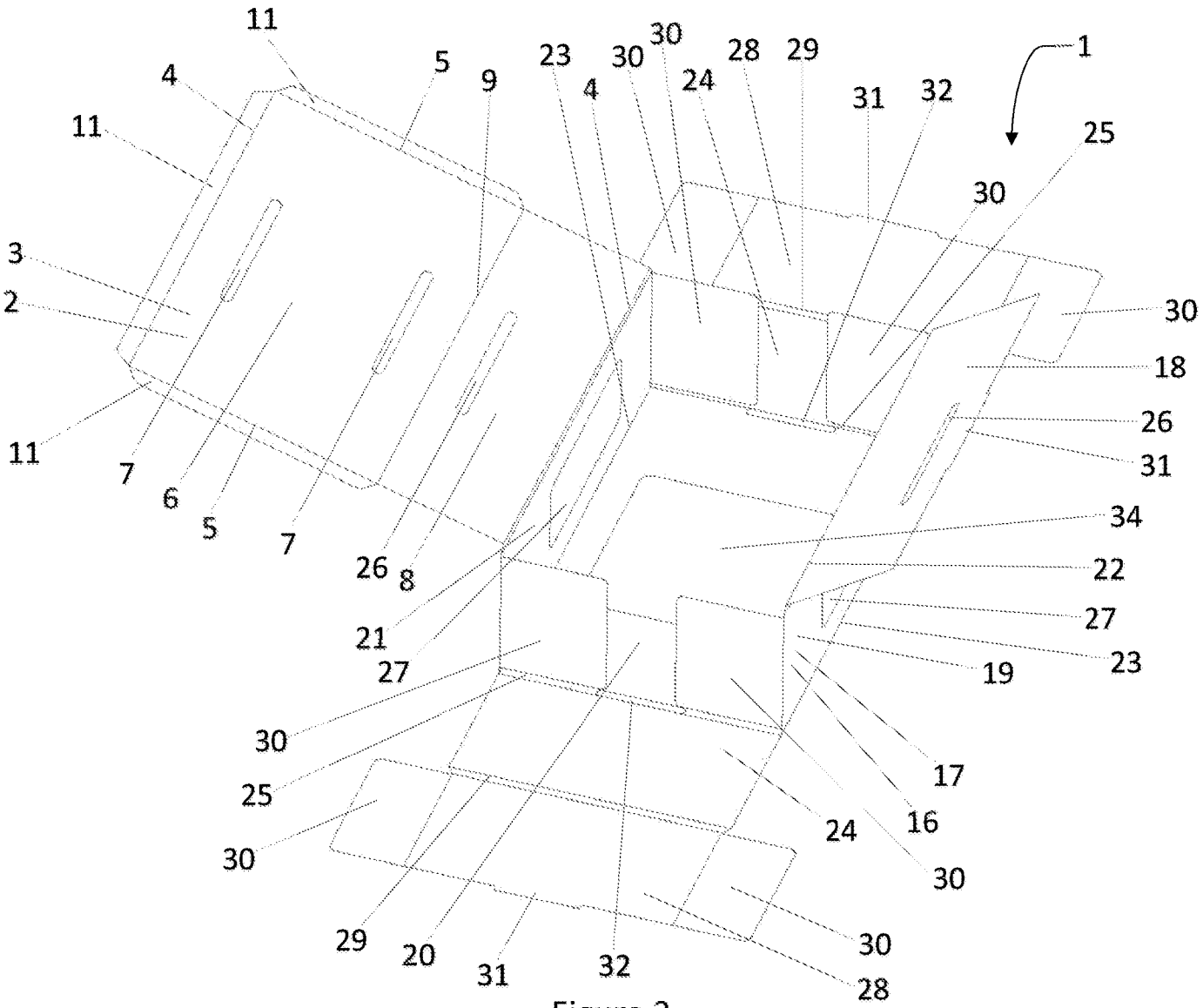
FIG. 3 depicts a perspective view of the embodiment of the packaging assembly as shown in FIG. 2 to illustrate the direction in which the second segment and the fourth segment are folded.

FIG. 3 depicts a perspective view of the embodiment of the packaging assembly (1) as shown in FIG. 2 to illustrate the direction in which the second segment (19) and the fourth segment (21) are folded; the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 4:
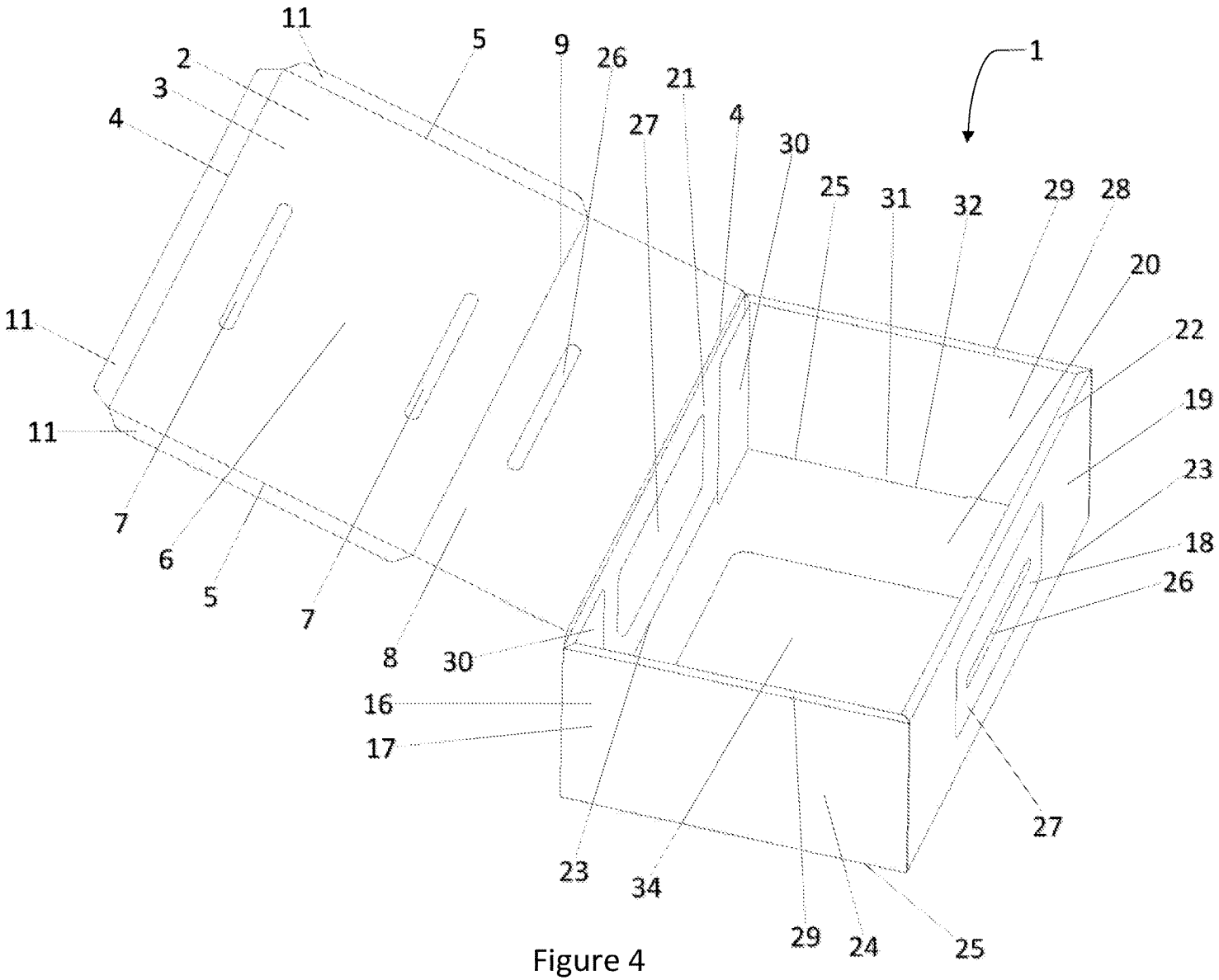
FIG. 4 depicts a perspective view of the embodiment of the packaging assembly as shown in FIG. 2 to illustrate a folded box portion with a tightening portion connected to an edge of the box portion.

FIG. 4 depicts a perspective view of the embodiment of the packaging assembly (1) as shown in FIG. 2 to illustrate a folded box portion (16) with a tightening portion (2) connected to an edge of the box portion (16); the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 5:
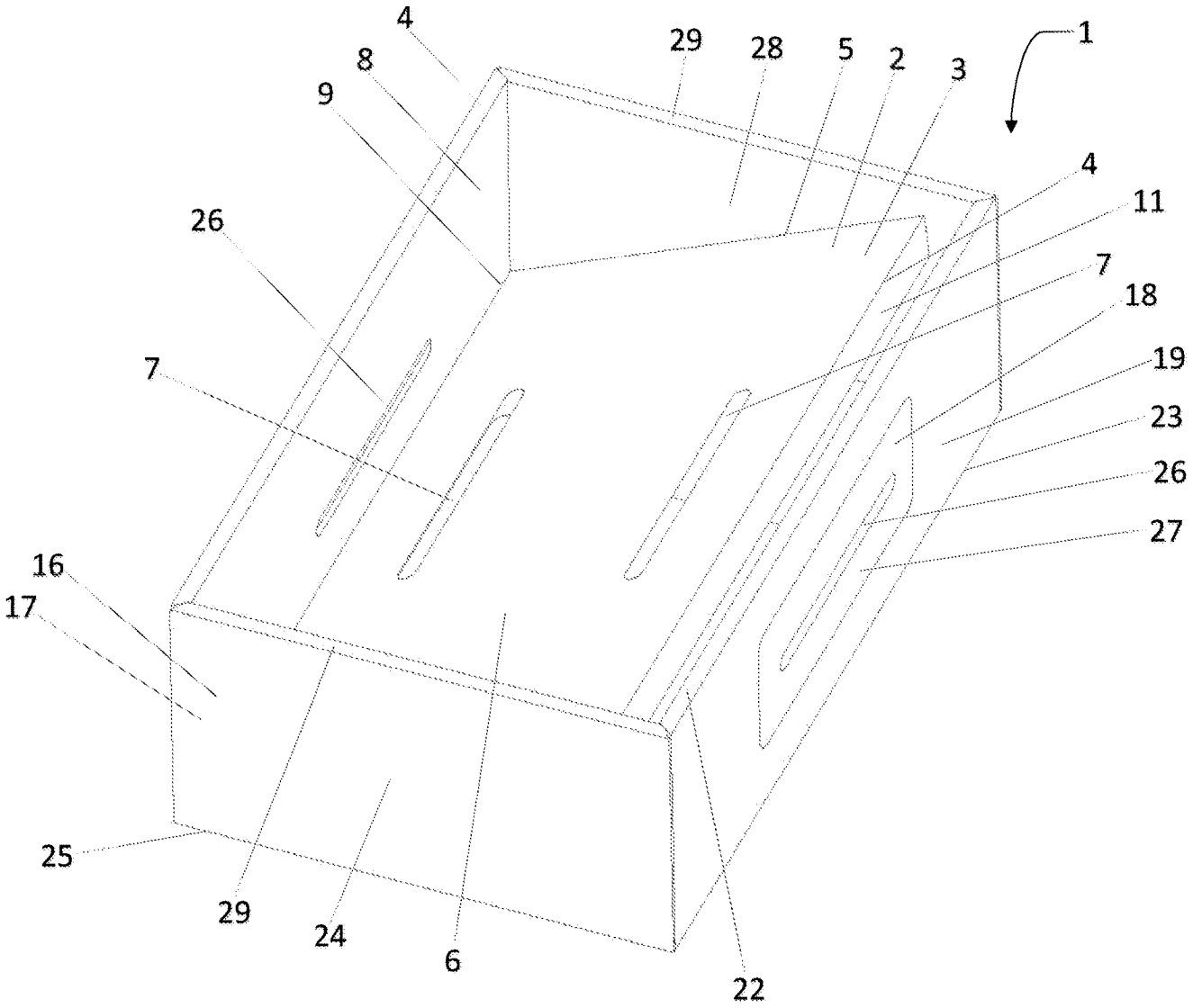
FIG. 5 depicts a perspective view of the embodiment of the packaging assembly as shown in FIG. 2 to illustrate the direction in which the first folding side portion is folded.

FIG. 5 depicts a perspective view of the embodiment of the packaging assembly (1) as shown in FIG. 2 to illustrate the direction in which the first folding side portion (8) is folded; the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 6:
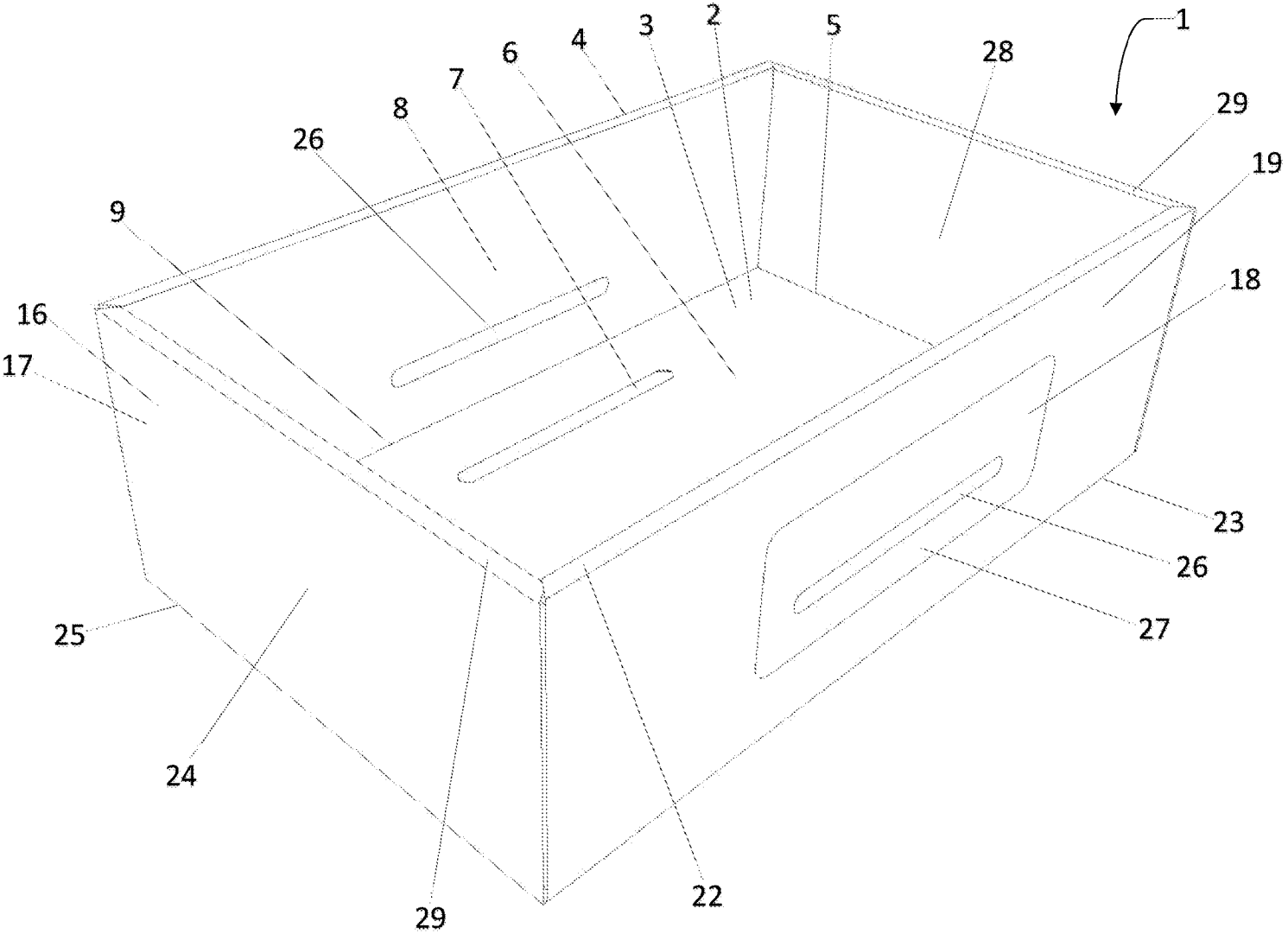
FIG. 6 depicts a perspective view of the embodiment of the packaging assembly as shown in FIG. 2 in a folded condition.

FIG. 6 depicts a perspective view of the embodiment of the packaging assembly (1) as shown in FIG. 2 in a folded condition comprising a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 7:
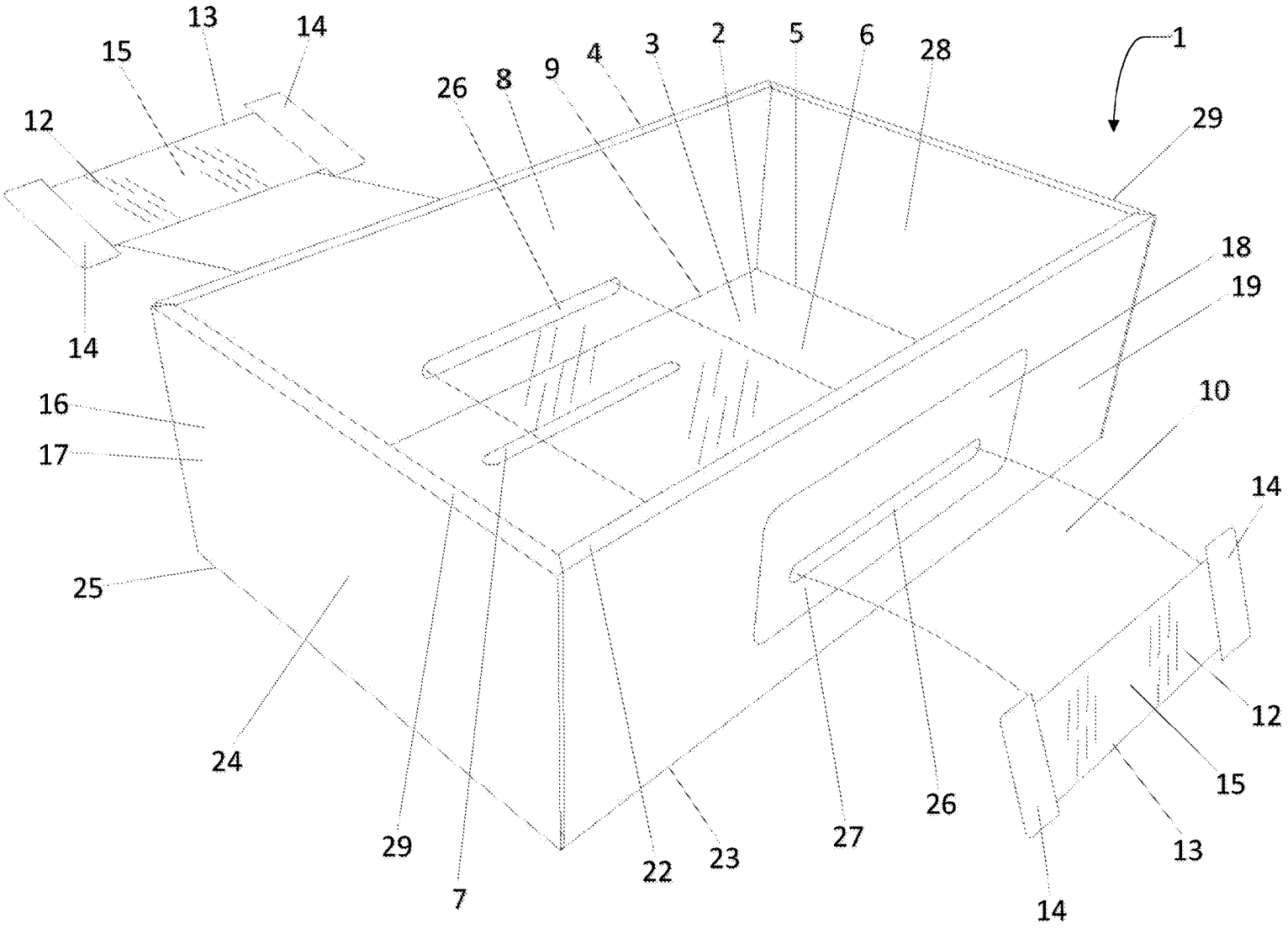
FIG. 7 depicts a perspective view of the embodiment of the packaging assembly as shown in FIG. 2 to illustrate the way in which the securing members and the flexible strip are configured to pass through the pair of second openings and the pair of third openings.

FIG. 7 depicts a perspective view of the embodiment of the packaging assembly (1) as shown in FIG. 2 to illustrate the way in which the securing members (13) and the flexible strip (10) are configured to pass through the pair of second openings (26) and the pair of third openings (27); the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 8:
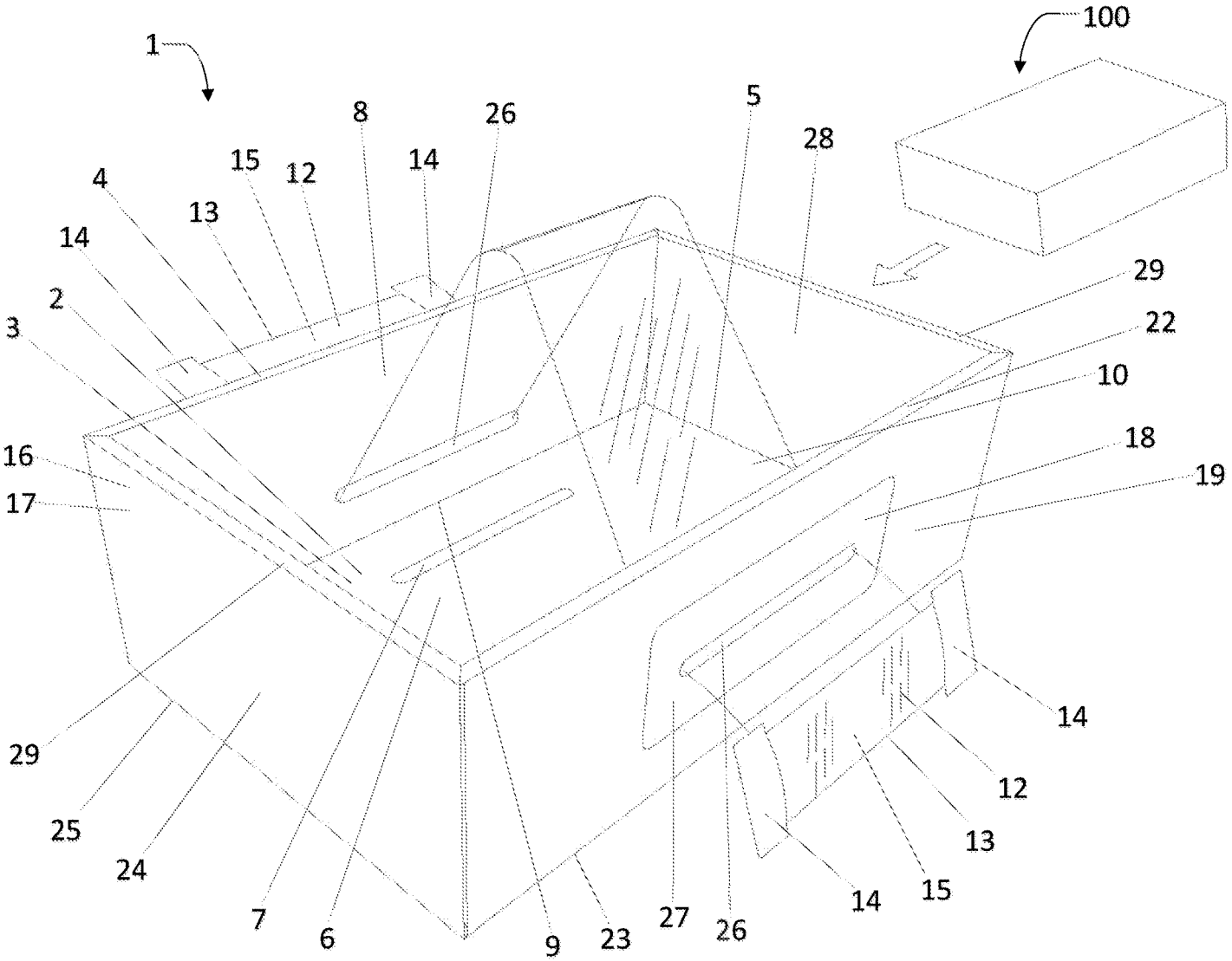
FIG. 8 depicts a perspective view of the embodiment of the packaging assembly as shown in FIG. 2 to illustrate the insertion of an object.

FIG. 8 depicts a perspective view of the embodiment of the packaging assembly (1) as shown in FIG. 2 to illustrate the insertion of an object (100); the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

Figure 9:
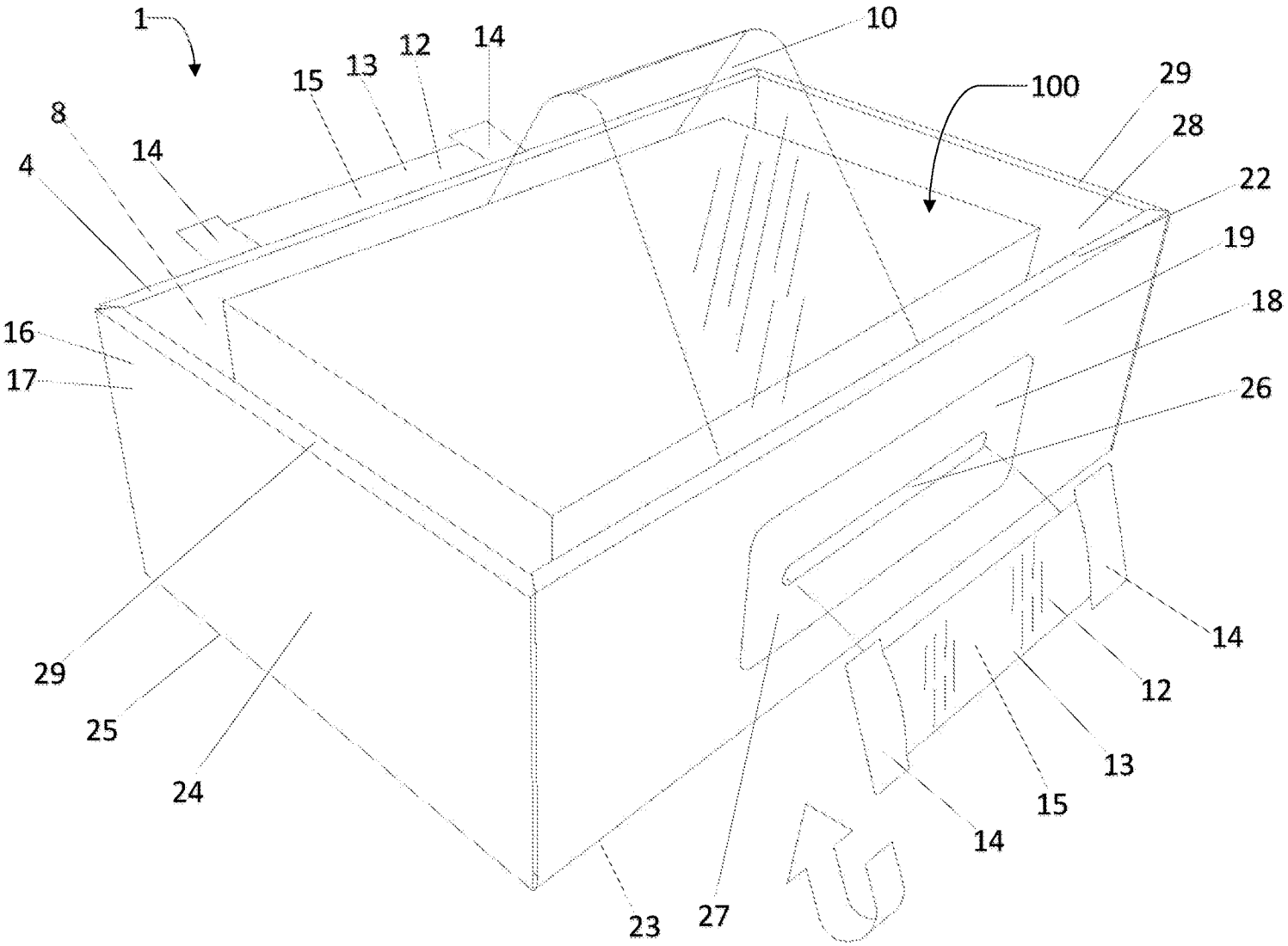
FIG. 9 depicts a perspective view of the embodiment of the packaging assembly as shown in FIG. 2 to illustrate the way in which the pair of securing members are rotated along the flexible strip until the pair of securing members are fastened against a surface of the second segment and fourth segment respectively to secure an object.

FIG. 9 depicts a perspective view of the embodiment of the packaging assembly (1) as shown in FIG. 2 to illustrate the way in which the pair of securing members (13) are rotated along the flexible strip (10) until the pair of securing members (13) are fastened against a surface of the second segment (19) and fourth segment (21) respectively to secure an object (100); the embodiment comprises a tightening portion (2), wherein the tightening portion (2) comprises a first rigid panel (3), wherein the first rigid panel (3) comprises a pair of first side edges (4) and a pair of first end edges (5); a center portion (6) near the center of the first rigid panel (3); a pair of first openings (7) near the center of the center portion (6); a first folding side portion (8) connected to either the right side or the left side of the center portion (6); a first fold line (9); and one or more supporting members (11) connected to the other sides of the center portion (6); wherein the pair of first side edges (4) are substantially transverse to the pair of first end edges (5), wherein the first fold line (9), one of the pair of first side edges (4) and the pair of first end edges (5) define the center portion (6), wherein the first fold line (9) is substantially parallel to the pair of first side edges (4), and wherein the first fold line (9), one of the pair of first side edges (4) and the pair of first end edges (5) define the first folding side portion (8); a flexible strip (10) having a pair of sleeves (12) at the both ends; a pair of dumbbell or dog-bone shaped securing members (13), each having a pair of end portions (14) and a center region (15), wherein the center region (15) is narrower than the end portions (14); and a box portion (16) with an open upper end, wherein the box portion (16) is formed by a second rigid panel (17) which can be folded into a box, and wherein the first side edge (4) on the first folding side portion (8) is integrally and foldably connected or bonded to an edge of the box portion (16); a first segment (18), a second segment (19), a third segment (20) and a fourth segment (21), wherein the first segment (18), the second segment (19), the third segment (20) and fourth segment (21) are of equal width, wherein the second segment (19) is between the first segment (18) and the third segment (20), wherein the third segment (20) is between the second segment (19) and the fourth segment (21), and wherein the fourth segment (21) is connected to the first rigid panel (3) through the first side edge (4); a second fold line (22) in between the first segment (18) and the second segment (19) and a pair of third fold lines (23) each in between the second segment (19) and the third segment (20) and in between the third segment (20) and the fourth segment (21) respectively, wherein the second fold line (22) and the pair of third fold lines (23) are substantially parallel to each other; a pair of proximal segments (24), each connected respectively to a side of the third segment (20) not connecting to the second segment (19) nor the fourth segment (21); a pair of fourth fold lines (25) each in between the third segment (20) and the pair of proximal segments (24), wherein the pair of fourth fold lines (25) are substantially transverse to the second fold line (22) and the pair of third fold lines (23); a pair of second openings (26), each near the center of the first folding side portion (8) and the first segment respectively (18); a pair of third openings (27), each near the center of the second segment (19) and the fourth segment (21) respectively; a pair of distal segments (28), each connected respectively to one of the proximal segments (24); a pair of fifth fold lines (29) each in between the pair of proximal segments (24) and the distal segments (28), wherein the pair of fifth fold lines (29) are substantially parallel to the pair of fourth fold lines (25), and wherein the pair of fifth fold lines (29) are substantially transverse to the second fold line (22) and the pair of third fold lines (23); a tuck tab (30 each foldably connected to the shorter sides of the second segment (19) and fourth segment (21); a tuck tab (30) each foldably connected to the shorter sides of the pair of distal segments (28); a locking tab (31) each on the edge of the pair of distal segments (28) and the first segment (18); a pair of fourth openings (32) each along or near each of the pair of fourth fold lines (25); a fifth opening (33) along or near the third fold line (23) in between the second segment (19) and the third segment (20), wherein the pair of fourth openings (32) are substantially aligned to the locking tabs (31) on the edges of the pair of distal segments (28), and wherein the fifth opening (33) is substantially aligned to the locking tab (31) on the edge of the first segment (18); and a sixth opening (34) in or near the center of the third segment (20).

FIGS. 1-9 depicts just one non-limiting embodiment of the packaging assembly disclosed herein. Variations and modifications from the embodiment exist.

As demonstrated above, embodiments of the invention provide packaging assemblies that are formed by folding a rigid panel into a box and securing objects onto the box by a flexible strip to prevent uncontrolled movement of the objects when the objects are packaged within the box. While the invention has been described with respect to a limited number of embodiments, the specific features on one embodiment should not be attributed to other embodiments of the invention. No single embodiment is representative of all aspects of the invention. Variations and modifications from the described embodiments exist. The appended claims intend to cover all such variations and modifications as falling within the scope of the invention.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purpose of clarity of understanding, it will be readily apparent to those of ordinary skill in the art in light of the teachings of this invention that certain changes and modifications may be made thereto without departing from the spirit or scope of the appended claims.

What is claimed is:

1. A packaging assembly comprising:

a) a tightening portion, wherein the tightening portion comprises a first rigid panel, wherein the first rigid panel comprises:

(i) a pair of first side edges and a pair of first end edges;

(ii) a center portion near the center of the first rigid panel;

(iii) a pair of first openings near the center of the center portion;

(iv) a first folding side portion connected to either the right side or the left side of the center portion;

(v) a first fold line; and (vi) one or more supporting members connected to the other sides of the center portion;

wherein the pair of first side edges are substantially transverse to the pair of first end edges, wherein the first fold line, one of the pair of first side edges and the pair of first end edges define the center portion, wherein the first fold line is substantially parallel to the pair of first side edges, and wherein the first fold line, one of the pair of first side edges and the pair of first end edges define the first folding side portion;

b) a flexible strip having a pair of sleeves at the both ends;

c) a pair of dumbbell or dog-bone shaped securing members, each having a pair of end portions and a center region, wherein the center region is narrower than the end portions; and d) a box portion with an open upper end, wherein the first side edge on the first folding side portion is integrally and foldably connected or bonded to an edge of the box portion, and wherein each of the pair of securing members engages with each of the pair of sleeves respectively in a manner such that at least a portion of the center region is inside the sleeve; and wherein each of the pair of securing members respectively is configured to pass through each of the pair of first openings and to tighten an object between the strip and the first rigid panel.

2. A method for packaging an object in the packaging assembly of claim 1, wherein the method comprises the steps of inserting one of the securing members through one of the pair of first openings on the first rigid panel, extending and through the other first opening on the first rigid panel, whereby at least a portion of an object positioned between the pair of first openings on the first rigid panel and the flexible strip is tightened against a least a portion of the object when the pair of securing members are rotated along the flexible strip until the pair of securing members are fastened against a surface of the first rigid panel.

3. The packaging assembly of claim 1, wherein the flexible strip further comprises a line of perforated holes across the width of the strip.

4. The packaging assembly of claim 1, wherein the flexible strip is an elastomer or a thermoplastic.

5. The packaging assembly of claim 1, wherein each of the securing members independently comprises a thermoplastic, a metal, wood, a fiberboard or a combination thereof.

6. The packaging assembly of claim 5, wherein each of the securing members is a thermoplastic.

7. The packaging assembly of claim 1, wherein the box portion is a substantially rectangular or square box with an open upper end.

8. The packaging assembly of claim 1, wherein the box portion is formed by a second rigid panel which can be folded into a box.

9. The packaging assembly of claim 8, wherein the second rigid panel comprises:

a) a first segment, a second segment, a third segment and a fourth segment, wherein the first segment, the second segment, the third segment and fourth segment are of equal width, wherein the second segment is between the first segment and the third segment, wherein the third segment is between the second segment and the fourth segment, and wherein the fourth segment is connected to the first rigid panel through the first side edge;

b) a second fold line in between the first segment and the second segment and a pair of third fold lines each in between the second segment and the third segment and in between the third segment and the fourth segment respectively, wherein the second fold line and the pair of third fold lines are substantially parallel to each other;

c) a pair of proximal segments, each connected respectively to a side of the third segment not connecting to the second segment nor the fourth segment;

d) a pair of fourth fold lines each in between the third segment and the pair of proximal segments, wherein the pair of fourth fold lines are substantially transverse to the second fold line and the pair of third fold lines;

e) a pair of second openings, each near the center of the first folding side portion and the first segment respectively; and f) a pair of third openings, each near the center of the second segment and the fourth segment respectively;

wherein each of the pair of securing members respectively is configured to pass through either the pair of second openings and the pair of third openings, or each of the pair of first openings, and to tighten an object between the strip and the first rigid panel.

10. The packaging assembly of claim 9, wherein the second rigid panel further comprises:

a) a pair of distal segments, each connected respectively to one of the proximal segments; and b) a pair of fifth fold lines each in between the pair of proximal segments and the distal segments, wherein the pair of fifth fold lines are substantially parallel to the pair of fourth fold lines, and wherein the pair of fifth fold lines are substantially transverse to the second fold line and the pair of third fold lines.

11. The packaging assembly of claim 10, wherein the second rigid panel further comprises:

a) a tuck tab each foldably connected to the shorter sides of the second segment and fourth segment;

b) a tuck tab each foldably connected to the shorter sides of the pair of distal segments;

c) a locking tab each on the edge of the pair of distal segments and the first segment;

d) a pair of fourth openings each along or near each of the pair of fourth fold lines; and e) a fifth opening along or near the third fold line in between the second segment and the third segment, wherein the pair of fourth openings are substantially aligned to the locking tabs on the edges of the pair of distal segments, and wherein the fifth opening is substantially aligned to the locking tab on the edge of the first segment.

12. The packaging assembly of claim 11, wherein the first rigid panel and the second rigid panel having an unfolded condition in which the tightening portion and the box portion are substantially coplanar with each other, and having a folded condition in which:

(i) the second segment and the fourth segment each are folded towards the third segment until the second segment and the fourth segment are each substantially transverse to the third segment, (ii) the tuck tabs on the second segment and the fourth segment are folded towards the third segment until the tuck tabs are substantially aligned to the pair of fourth fold lines and substantially transverse to the third segment, (iii) the pair of proximal segments are folded towards the third segment until the pair of proximal segments are substantially transverse to the third segment, (iv) the pair of distal segments are folded towards the third segment until the pair of distal segments are substantially transverse to the third segment and the locking tabs on each of the edges of the pair of distal segments are each inserted through the closest fourth opening, (v) the first segment is folded towards the third segment until the first segment is substantially transverse to the third segment and the locking tab on the edge of the first segment is inserted through the fifth opening, and (vi) the first folding side portion and the supporting members are folded towards the third segment until the first folding side portion and the supporting members are substantially transverse to the third segment and the center portion of the first rigid panel is above the third segment.

13. A method for packaging an object in the packaging assembly of claim 12, wherein the first rigid panel and the second rigid panel are in the folded condition, and wherein the method comprises the steps of inserting one of the securing members through one of the pair of third openings, extending across the center portion and through the other third opening, whereby at least a portion of an object positioned between the center portion and the flexible strip is tightened against a least a portion of the object when the pair of securing members are rotated along the flexible strip until the pair of securing members are each fastened against a surface of the second segment and the fourth segment respectively.

14. The packaging assembly of claim 12, wherein the second rigid panel further comprises a sixth opening in or near the center of the third segment.

* * * * *